US006340273B1

(12) United States Patent
Hull

(10) Patent No.: US 6,340,273 B1
(45) **Date of Patent: *Jan. 22, 2002**

(54) SUPPORT STRUCTURE FOR WELLS, PRODUCTION FACILITIES, AND DRILLING RIGS

(75) Inventor: Tommy Lee Hull, Needville, TX (US)

(73) Assignee: OPE, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/966,098

(22) Filed: Nov. 7, 1997

(51) Int. Cl.[7] ..... E02B 17/00
(52) U.S. Cl. ..... 405/227; 405/224; 405/195.1
(58) Field of Search ..... 405/195.1, 203, 405/204, 208, 224, 227, 228

(56) References Cited

U.S. PATENT DOCUMENTS 3,379,245 A * 4/1968 Manning ..... 405/227
4,812,080 A * 3/1989 Urquhart et al. ..... 405/227
4,917,541 A * 4/1990 Carruba ..... 405/224
4,983,074 A * 1/1991 Carruba ..... 405/224
5,102,266 A * 4/1992 Carruba ..... 405/227
5,536,117 A * 7/1996 Frame et al. ..... 405/224

* cited by examiner

*Primary Examiner*—David Bagnell
*Assistant Examiner*—Frederick L. Lagman
(74) *Attorney, Agent, or Firm*—David M. Ostfeld

(57) ABSTRACT

A support structure is disclosed for use in drilling and production operations having one end positioned above a body of water and another end below the body of water on a bed. The support structure includes a base and a jacket structure having at least three jacket legs and support members for supporting a structure, such as a deck. The base has at least four cylindrical base legs engageably positioned in a generally rectangular pattern on the bed and a base frame connected to the cylindrical base legs. The cylindrical base legs start and terminate below the body of water. The jacket has a first jacket leg, a second jacket leg, a third jacket leg. The first, second, and third jacket legs start below the body of water and terminate above the body of water and are positioned with the support members for supporting a structure above the body of water. The first jacket leg is attached to one of the cylindrical base legs and the second jacket leg is attached to another of the cylindrical base legs. The base frame extends between the cylindrical base legs to which the first jacket leg and the second jacket leg are attached and to the third jacket leg to form a triangular shape.

29 Claims, 14 Drawing Sheets

SUPPORT STRUCTURE FOR WELLS, PRODUCTION FACILITIES, AND DRILLING RIGS

FIELD OF THE INVENTION

The invention relates to offshore structures and more particularly to a support structure for supporting wells, production facilities, and/or drilling rigs located in a body of water.

BACKGROUND

In the drilling and production of hydrocarbons and other fluid minerals at offshore sites, offshore platforms are installed for the support of the necessary above water facilities and related equipment to accomplish such drilling and production. Often the size, weight and number of facilities and equipment preclude the use of minimal support structures having less than three legs anywhere between the sea floor and the facilities deck. Support structures having less than three legs must resist eccentric gravity loads and lateral environmental loads such as wind, wave, current and seismic by developing internal bending moment in the legs, whereas the support structures having three or more legs resist the loads primarily be developing internal axial loads. Support structures having three or more legs are stiffer and more efficient than the minimal structures for any loading other than very minimal loads. Production facilities are especially sensitive to motion which occurs under cyclic or intermittent loading and are adversely affected by the motions of the more flexible minimal structures. As is well-known in the art, an active wave zone exists as part of the surface of a body of water. Such wave zone produces loading on production and drilling facilities and other support structures located in a body of water.

Given the need for support structures which have three or more legs, current technology has provided conventional pile-supported jackets. Jackets having three legs are called tripods. Decks can be connected to the jacket by conventional methods, including transitions which allow decks to have a different number of legs than the jacket has.

Tripods have the advantage of presenting less surface area to wind, wave and current than a structure having more legs. Tripods are, however, inefficient in resisting the applied lateral loads and applied overturning moments. Tripods have the minimum number of piles and thus, each pile must carry more lead than would a structure having a base with more than three legs, assuming both the tripod and the structure with more legs were both evenly loaded.

The installation cost of offshore platform jackets is a major factor. A tripod jacket sometimes must be fabricated in a position in which its vertical axis is rotated 70 to 90 degrees toward horizontal, and is transported to the final erection site in that orientation. Tripods are lifted from the transportation vessel and placed in the body of water. Tripods are unstable in water when floating in the rotated position. They tend to roll to one side, which presents safety hazards and causes extra time and costs in rigging the lifting slings, work platforms and other apparatus. Jackets are temporarily supported by mudmats which rest on the ground below the body of water. Mudmats are most effective when placed at the outer corners of the base. The mudmats of a structure having more than three legs are more efficient than the mudmats of a similar sized tripod for the same reasons that apply to efficiency of piles. The combination of a tripod (also called a jacket structure) and base that is more efficient in distributing applied load; more stable when floating; and is more stable when resting on mudmats would be highly desirable.

Pile efficiency and jacket efficiency are significantly affected by the geometrical arrangement of piles. Current technology for tripods has piles near or within the jacket legs. Current technology does not use piles or pile groups as effectively as possible by allowing one to transition from a base configuration to a jacket configuration that is different from the base configuration. Consider a triangular base with each side having a length, L, and a rectangular base with each side having a length, L. There would be a pile or pile group at each corner of each base. If each base were to resist the same overturning moment, then the maximum reaction for the triangular base would be 1.4 times the maximum reaction for the rectangular base. The pile foundation must carry vertical loads in addition to overturning moment. Each pile of the triangular base would carry 1.33 times the load for the rectangular base, assuming the vertical load passed through the combined centroid of the piles of the base. The costs for fabrication, handling, and installation of piles would be significantly higher for the triangular base than for the rectangular base. The principles apply to tripods with other types of polygonal bases.

The prior art does not disclose improving the efficiency of load distribution to the structure and piles by arranging braces on the faces of the jacket so that well conductors may start outside the face of the jacket above the water line and then pass through the face of the jacket to be inside the perimeter of the jacket the remainder of the way to the ground below the body of water. A jacket design that allows the well conductors to pass through the jacket and terminate outside the jacket above the water's surface would be highly desirable.

It is an object of the present invention to provide a jacket structure having three legs combined with a base which resists applied loads more efficiently.

It is another object of the present invention to provide improved efficiency of a support structure and/or piles by configuring the base of the structure such that the base has a larger number of legs than the structure above the base has.

It is a further object of the present invention to provide a structure that permits the well conductors to start outside the face of the jacket above the water line and then pass through the face of the jacket to be inside the perimeter of the jacket.

SUMMARY OF THE INVENTION

A support structure for use in drilling and production operations having one end positioned above a body of water and another end below the body of water on a bed is disclosed. Examples of such structures are deck platforms for supporting drilling rigs and production facilities. The support structure includes a base and a jacket structure having at least three jacket legs and a support means for supporting a structure such as a deck. The base has at least four cylindrical base legs engageably positioned in a generally rectangular pattern on the bed and a base frame connected to the cylindrical base legs. The cylindrical base legs start and terminate below the body of water. Preferably, each of the cylindrical base legs is sized to engageably receive at least one pile, and the pile is adapted to be driven into the bed.

The jacket has a first jacket leg, a second jacket leg, a third jacket leg. The first, second, and third jacket legs start below the body of water and terminate above the body of water and are positioned with the support means for supporting a structure above the body of water. The first jacket leg may be attached to one of the at least four cylindrical base legs and the second jacket leg may be attached to another of the at least four cylindrical base legs. The base frame extends between the cylindrical base legs to which the first jacket leg and the second jacket leg may be attached to the third jacket leg to form a triangular shape. The triangular shape, preferably, is a substantially isosceles triangle.

The support structure described herein has a base and jacket structure that is supported by piles, also referred to as skirt piles. Skirt pile sleeves are an integral part of the legs of the base of the structure. To secure the base to the bed, skirt piles are driven through the skirt pile sleeves. Each skirt pile is securely connected to a skirt pile sleeve. Methods of connection between pile and sleeve are mechanical, grouted or welded. Each pile is driven into the ground below the body of the water to a distance of penetration calculated sufficient to safely carry the applied loads.

The invention provides improved efficiency of the structure and/or piles by configuring the base of the structure such that the base has a larger number of legs than the structure above the base has, and the legs are placed at the outer corners of the base perimeter. The base has at least four legs, at least four sides, and at least four corners. The jacket has three legs. The invention improves the efficiency of the structure and/or piles by also providing a means for conductors to start outside a jacket, pass through the face of the jacket, and be within the perimeter of the jacket at the ground below the body of water The invention has an additional advantage of having more stability than a rotated floating tripod, making installation safer and cheaper than for a standard tripod. The invention is also more stable than a tripod of the same size when resting on mudmats. No extraordinary means or methods of fabrication or installation are required to build the invention and thus no extra costs are incurred.

BRIEF DESCRIPTION OF THE DRAWINGS

For a further understanding of the nature and objects of the present invention, reference should be made to the following detailed description in which like parts are given like reference numerals and wherein.

DETAILED DESCRIPTION OF THE PREFERRED EMBODIMENTS

Figure 1:
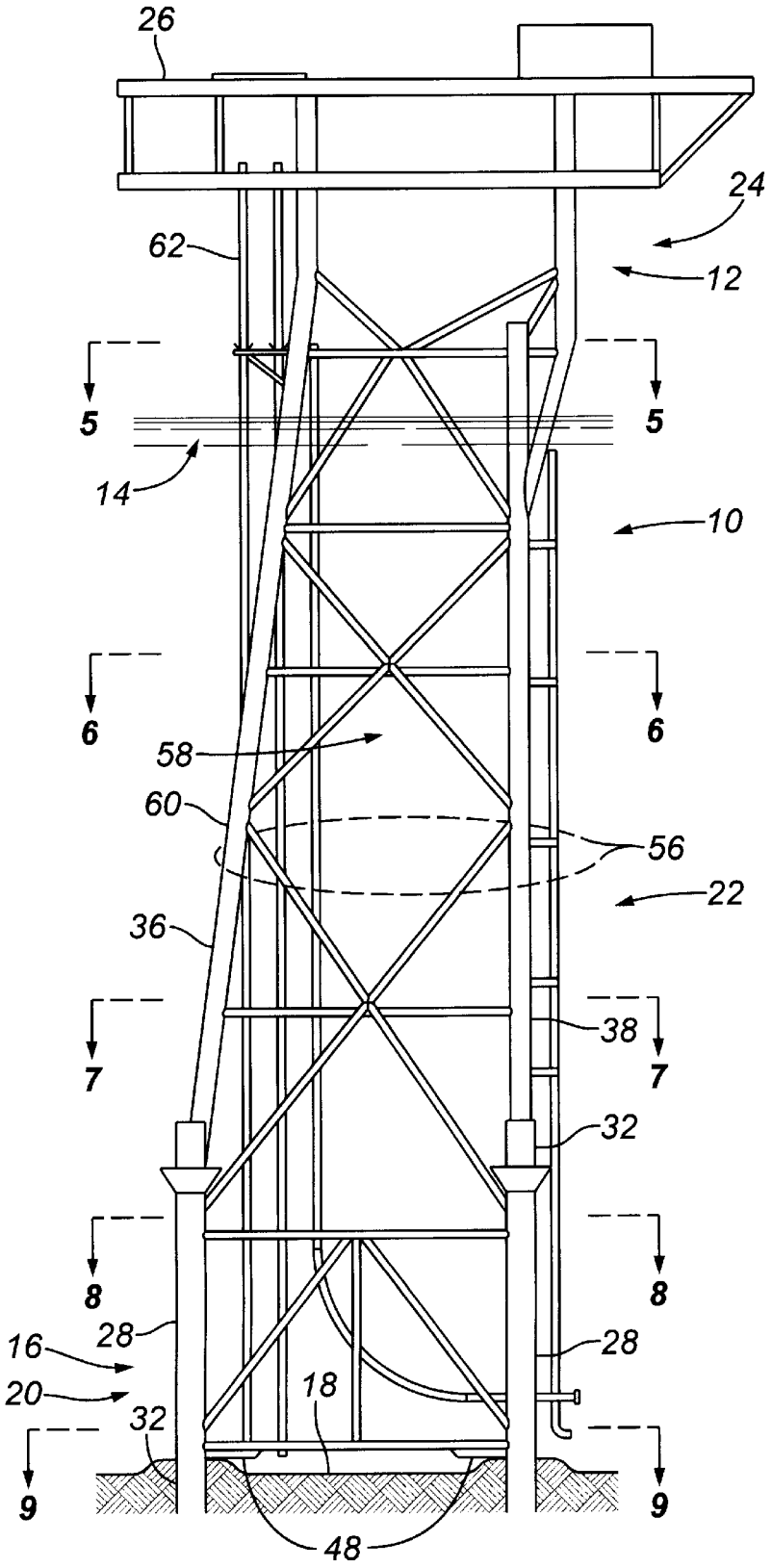
FIG. 1 is a three dimensional side view of the support structure in accordance with the present invention, and a deck structure supported by the jacket structure.

The embodiments of the present invention provide for a support structure 10 for use in drilling and production operations having one end 12 positioned above a body of water 14 having an active wave zone and another end 16 below the body of water 14 on a bed 18, such as shown in FIG. 1. Examples of use of such structures are for deck platforms for supporting drilling rigs and production facilities. The support structure includes a base 20, a jacket structure 22 having, preferably, three legs such as jacket leg or jacket members 36, and a means or extensions or tubular members 24 for supporting a structure such as a deck 26. The extensions 24 are attached to the jacket structure 22. More than three extensions 24 can be used. The extensions 24 extend upward to which a deck or other support structure 26 can be mounted.

The base 20 has a top facing towards the active wave zone and a bottom facing towards the seabed and has at least four cylindrical base legs 28 engageably positioned in a generally rectangular pattern on the bed 18 and a base frame 30 connected to the cylindrical base legs 28. The cylindrical base legs 28 start at the bed 18 below the body of water 14 and terminate above the bed 18 while still in the body of water 14. Preferably, each of the cylindrical base legs 28 has a hollow interior 29 that is sized to engageably receive at least one pile 32. The pile is adapted to be driven into the bed 18, as is well known in the art.

Figure 2:
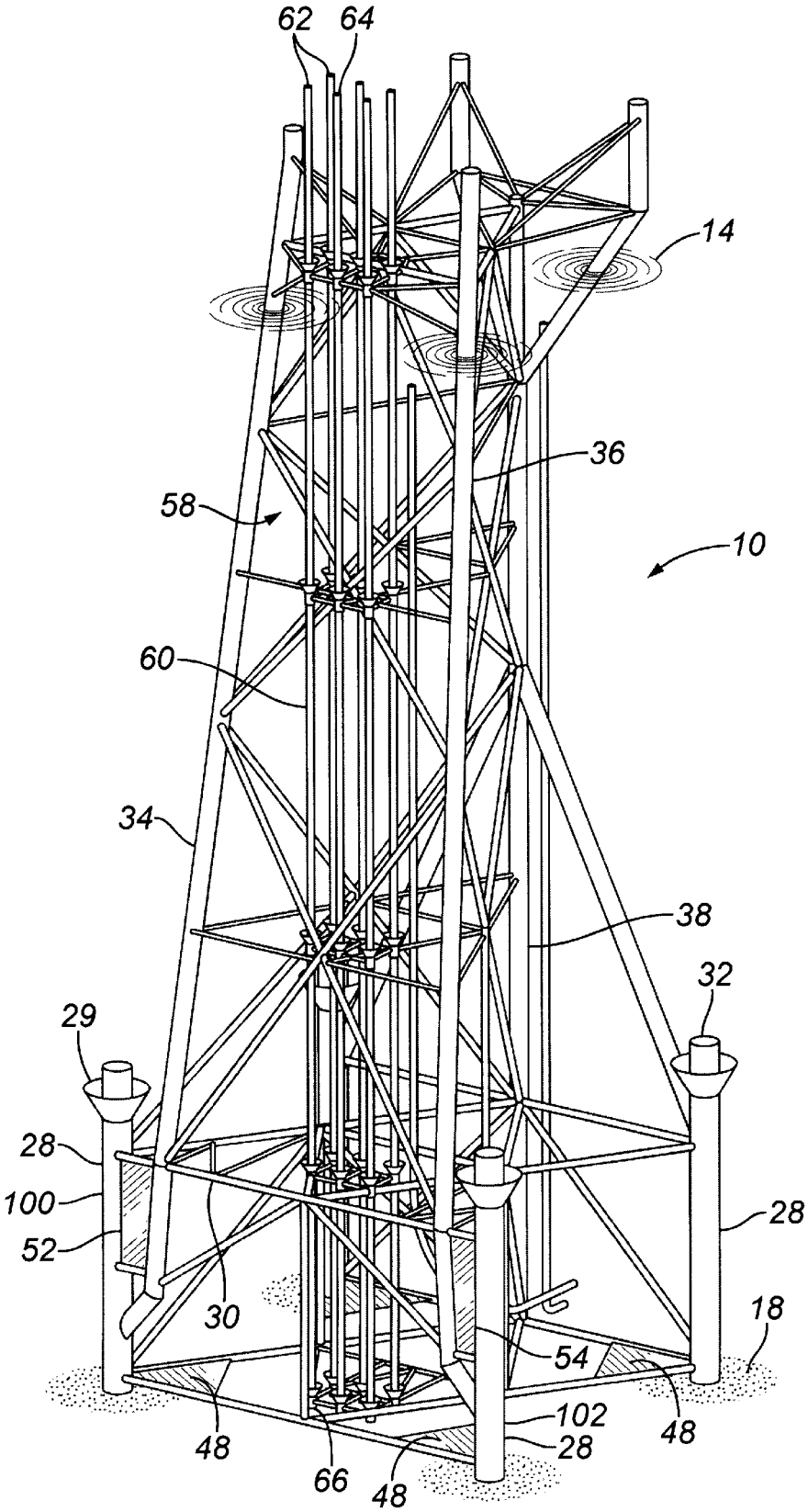
FIG. 2 is a three dimensional perspective view of the support structure in accordance with an embodiment of the present invention.

The jacket 22 has a first jacket leg 34 (FIG. 2), a second jacket leg 36, and a third jacket leg 38, where as shown in FIG. 2, said leg 34 and said leg 36 are battered and are co-planer. The plane of said leg 34 and said leg 36 is also battered. The first, second, and third jacket legs 34, 36, 38 originate below the body of water 14 and terminate above the body of water 14 and are positioned at their upper end as part of the support means 24 for supporting a structure 26 above the body of water 14. The first jacket leg 34 is attached to one of the cylindrical base legs 28 and the second jacket leg 36 is attached to another of the cylindrical base legs 28. The base frame 30 extends between the cylindrical base legs 28 to which the first jacket leg 34 and the second jacket leg 36 are attached to the third jacket leg 38 to form a triangle shaped frame. The triangle shaped frame, preferably, is in the form of a substantially isosceles triangle. This configuration allows one to transition from a base having one configuration to a jacket configuration that is different from the base configuration. Thus, the base forms or includes a foundation system for the main jacket legs 34, 36, 38 which while substantially vertical may be inclined as they rise from the base to the surface of the water and the vertical projections at any time remain within the geometry of the base, as shown in FIGS. 1 and 2.

Having a base with at least four legs and a jacket with three legs has several advantages over the current technology. Consider a triangular base with each side having a length, L, and a rectangular base with each side having a length, L. There would be a pile or pile group at each corner of each base. If each base were to resist the same overturning moment, then the maximum reaction for the triangular base would be 1.4 times the maximum reaction for the rectangular base. The pile foundation must carry vertical loads in addition to overturning moment. Each pile of the triangular base would carry 1.33 times the load for the rectangular base, assuming the vertical load passed through the centroid of each pile of the base. The costs for fabrication, handling, and installation of piles would be significantly higher for the triangular base than for the rectangular base. The principles apply to tripods with other types of polygonal bases.

In a preferred embodiment, the first jacket leg 34, the second jacket leg 36 and each of the cylindrical base legs 28 to which the first jacket leg 34 and the second jacket leg 36 are attached are aligned substantially vertically. The first jacket leg 34 has a first end 40 (FIG. 4) that terminates in the cylindrical base leg 28 to which it is attached and a second end 42 that terminates in the support means 24 for supporting a structure 26 (FIG. 1). Likewise, the second jacket 36 has a first end 44 that terminates in the cylindrical base leg 28 to which it is attached and a second end 46 that terminates in the means for supporting a structure 26. (FIG. 4) Thus two of the jacket legs 34, 36 are preferably fixedly attached to base legs 28 of the support structure 10. The inclination of the jacket legs 34, 36 above the base 20 may be different from their inclination within the base 20.

FIG. 2 shows a three-dimensional perspective view of the offshore platform shown in FIG. 1, except that the deck structure 26 has been omitted. Mudmats 48 are located near each base leg 28 of the support structure 10 and are connected to adjoining parts of the base frame 30.

Figure 3:
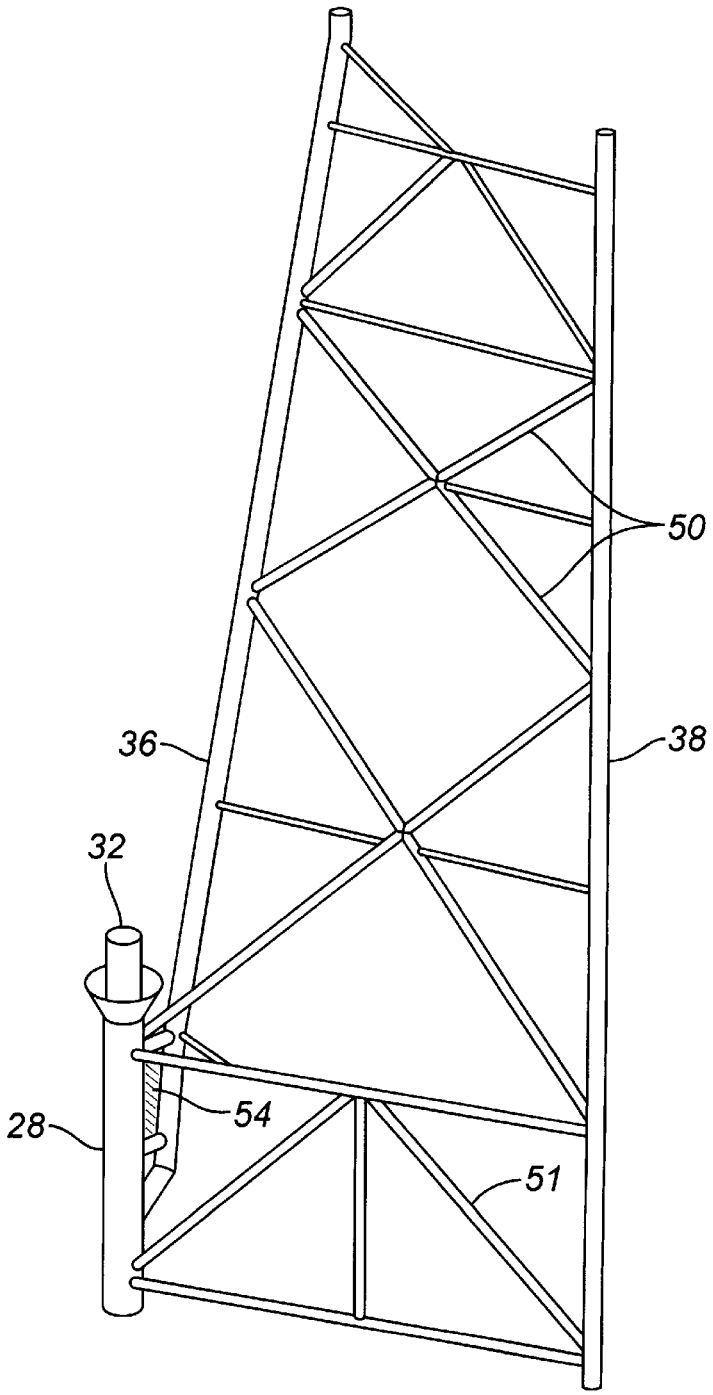
FIG. 3 is a three dimensional partial view of one of the side faces of the jacket structure in accordance with the present invention.
Figure 15:
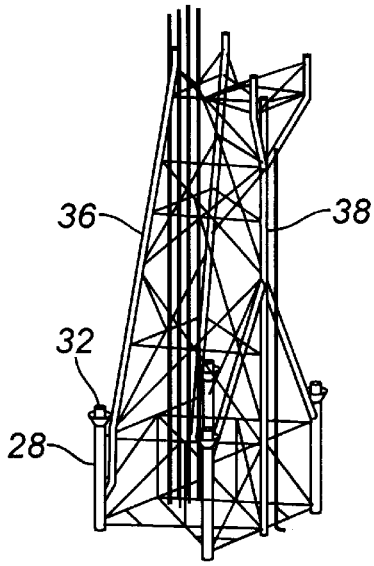
FIG. 15 is a perspective view of the support structure.
Figure 4:
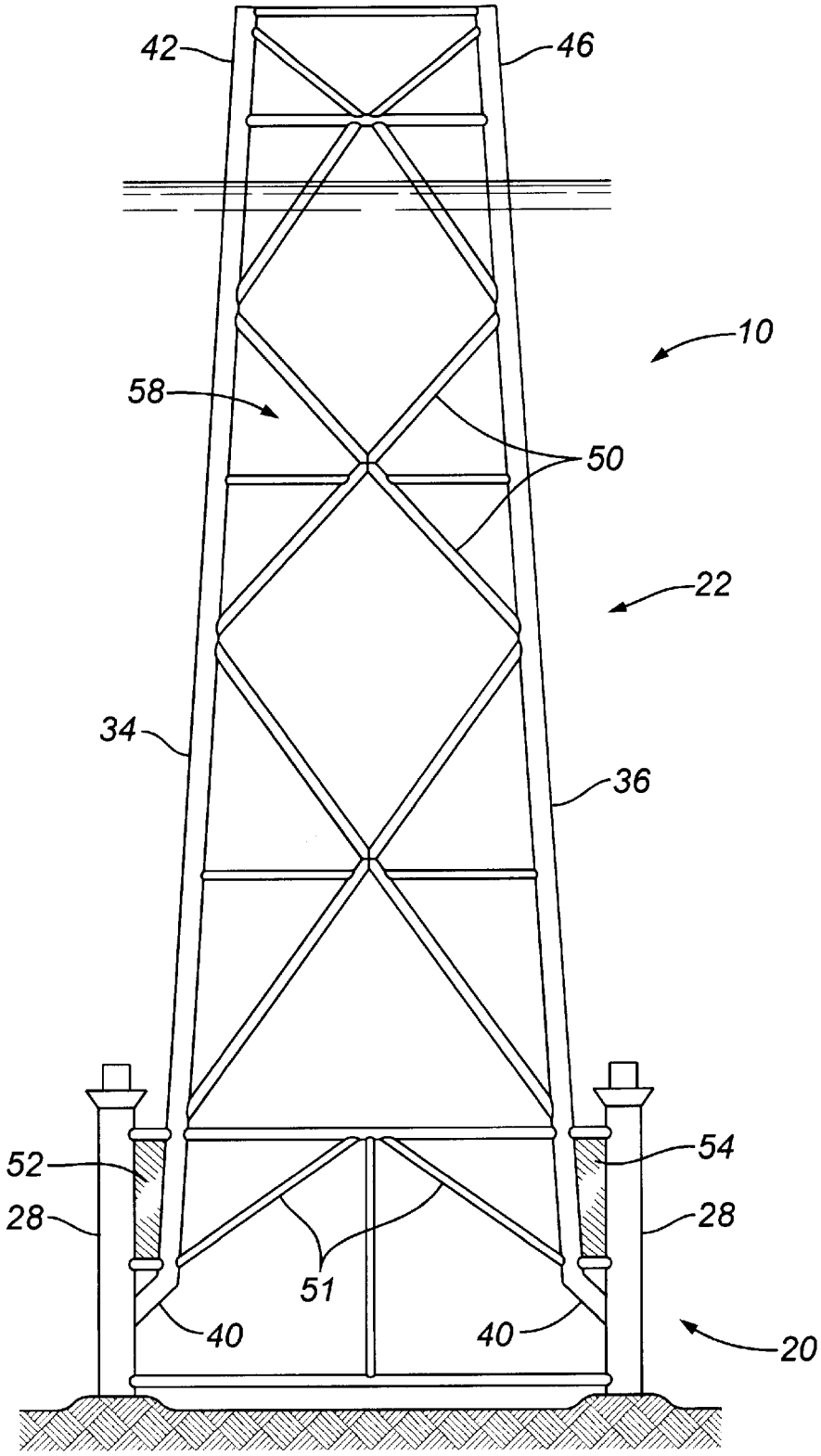
FIG. 4 is a three dimensional partial view of the jacket face in accordance with the present invention.

With reference to FIG. 3 and FIG. 4, a plurality of angularly extending brace members 50 are arranged between and interconnect the legs 34, 36, 38 of the jacket 22 and a plurality of lateral brace members 51 also are arranged between and interconnect the legs of the base 20. Plate members 52, 54 are arranged between and interconnect the legs of the jacket 22 structure and base legs 28. (FIG. 4)

An additional plurality of tubular guides and an additional plurality of cross brace members may be provided as may be required for a specific design. The cross brace patterns shown in the figures are for illustrative purposes only. The pattern, number of cross braces, and number of tubular guides will change depending on the design parameters for a specific operation at a specific site.

The plurality of angularly extending brace members 50 are connected between the first jacket leg 34, the second jacket leg 36 and the third jacket leg 38 in a vertically inclined face defined between each pair of jacket legs: 34 and 36; 36 and 38; and 34 and 38, to form a multi-sided structure defining a perimeter 56. The vertically inclined face between, for example, the first jacket leg 34 and the second jacket leg 36 is referred to as a jacket face 58. The jacket face 58 is formed between the first and second jacket legs 34, 36 that are attached to the cylindrical base legs 28. The first and second jacket legs 34, 36 are attached to the base legs 28 using the first plate member 52 and the second plate member 54 as discussed above. Alternatively, the cylindrical base legs 28 can be attached using braces like those used in the base frame 30.

When used in production, the support structure 10 can have a plurality of well conductors 62 attached to the structure. (See FIGS. 1 and 2) Each of the plurality of well conductors 62 have a first end 64, usually extending above the water line of the body of water 14, and a second end 66 extending upward from the bed 18. The plurality of well conductors 62 extend upward toward the surface of the body of water 14, and intersect the jacket face 58 at an intersection position 60 so that the first end 64 is outside of the perimeter 56 of the jacket 22 and the second end 66 is inside the perimeter 56 of the jacket 22.

Figure 9:
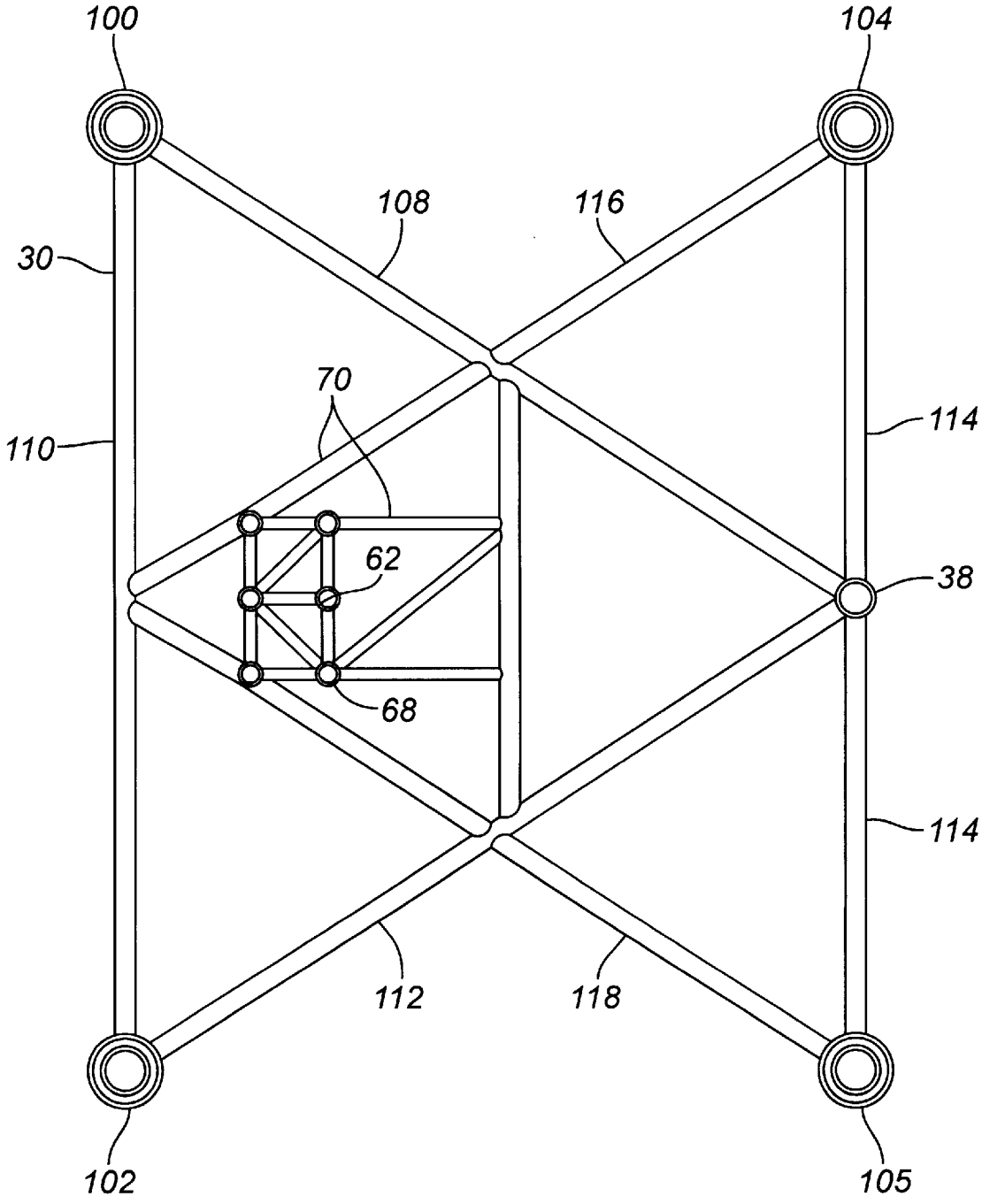
FIG. 9 is a plan view of the base taken along the line 9—9 in FIG. 1.
Figure 16:
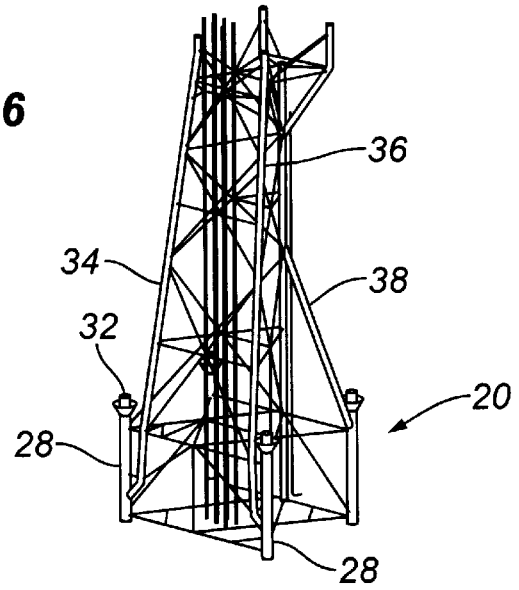
FIG. 16 is a perspective view of the support structure.
Figure 10:
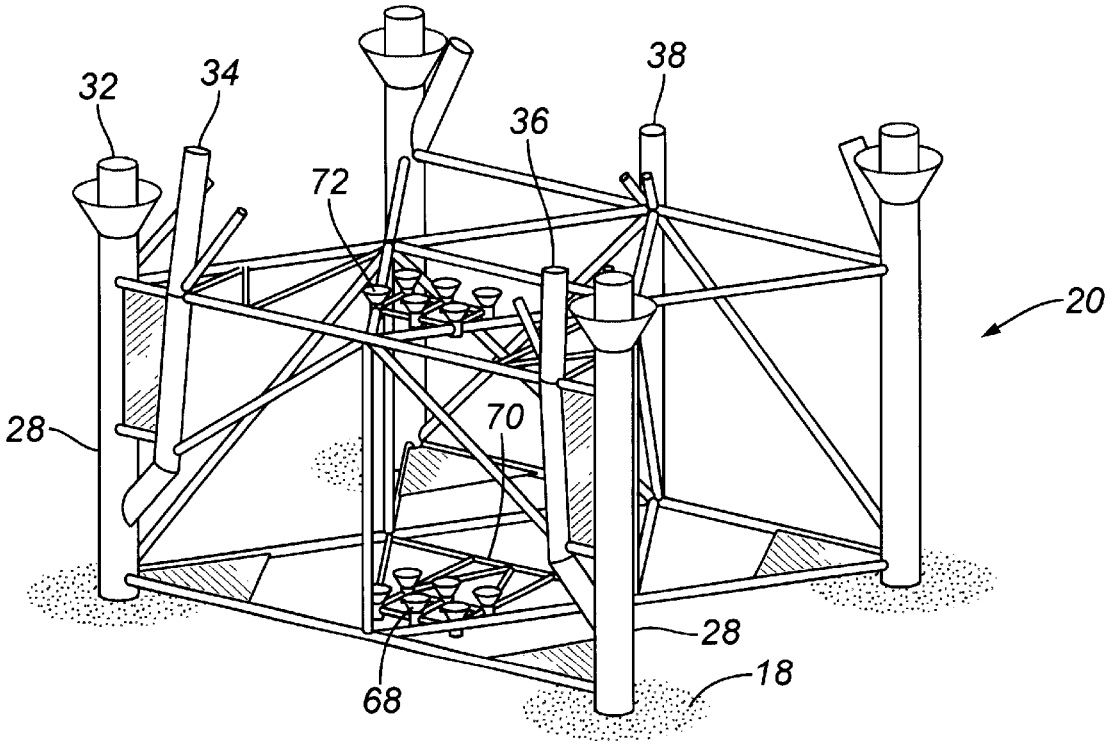
FIG. 10 is a three dimensional view of the base of the support structure in accordance with the present invention.

In use, the base 20 can have a first plurality of tubular guides 68 (FIG. 9) for receiving and supporting a plurality of well conductors 62 and a first plurality of cross brace members 70 for support. The first plurality of tubular guides 68 are attached to the base frame 30 by the first plurality of cross brace members 70 as illustrated in FIG. 9. The first plurality of cross brace members 70 are connected at one end to the first plurality of tubular guides 68 and at the other end to the base frame 30. The second end 66 of the well conductors 62 is received by the first plurality of tubular guides 68, and as set out above, is positioned inside the perimeter 56 of the jacket 22 near the base 20. Preferably there is provided, a second, third, fourth and fifth plurality of tubular guides, 72, 80, 86, 92, attached to the base frame 30 or the jacket structure 22 and positioned to permit the well conductors 62 to penetrate the jacket face 58 as they extend upward.

Figure 8:
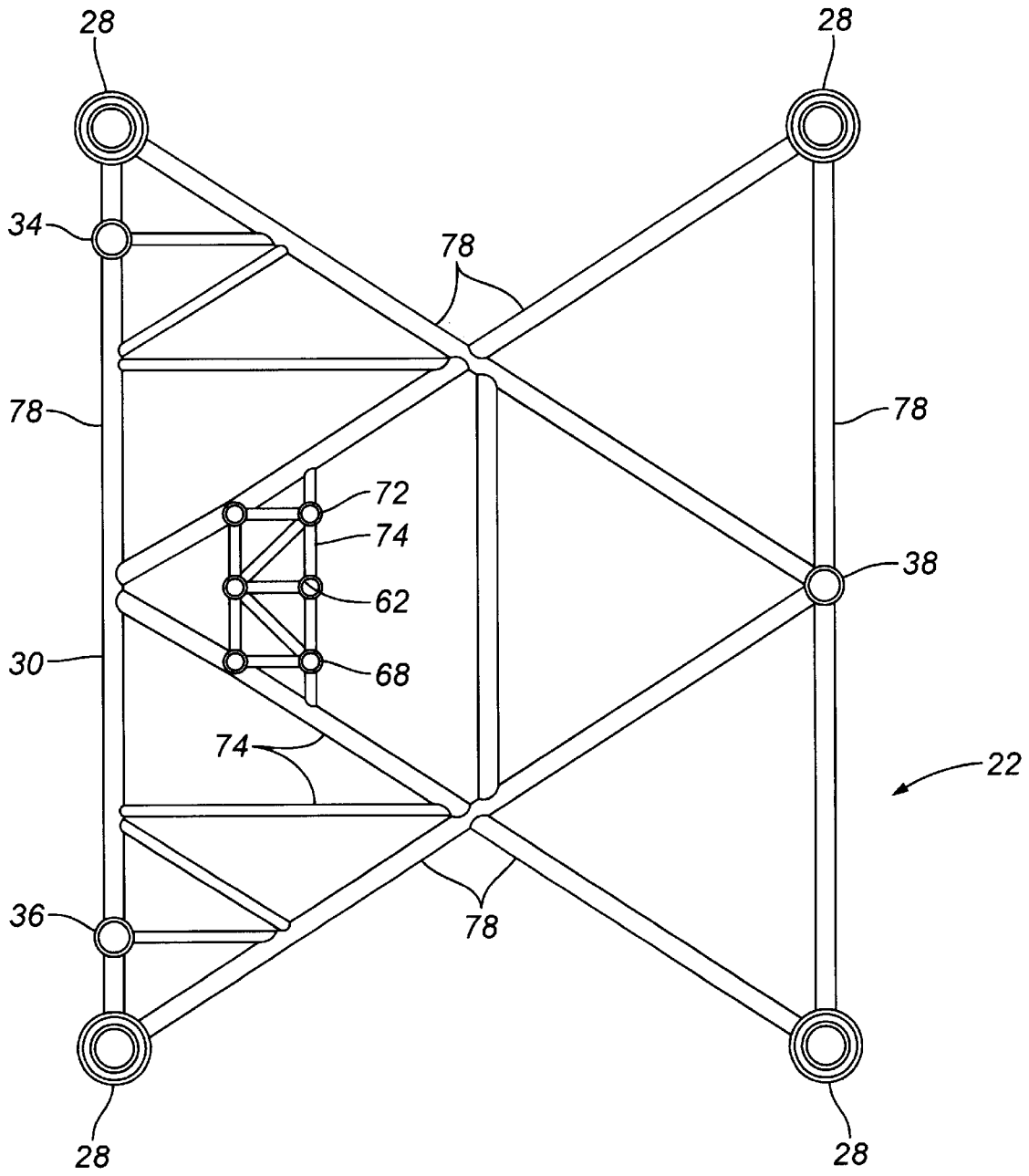
FIG. 8 is a plan view taken along the line 8—8 in FIG. 1.

FIG. 8 shows the second plurality of tubular guides 72 positioned inside the perimeter 56 of the jacket 22 and between the bed 18 and the body of water 14. The second plurality of tubular guides 72 are attached to the jacket 22 by a second plurality of cross brace members 74. This figure also illustrates a first plurality of cross structural brace members 78 which are arranged between and interconnect the base legs 28 with the first, second and third jacket legs 34, 36, 38.

Figure 7:
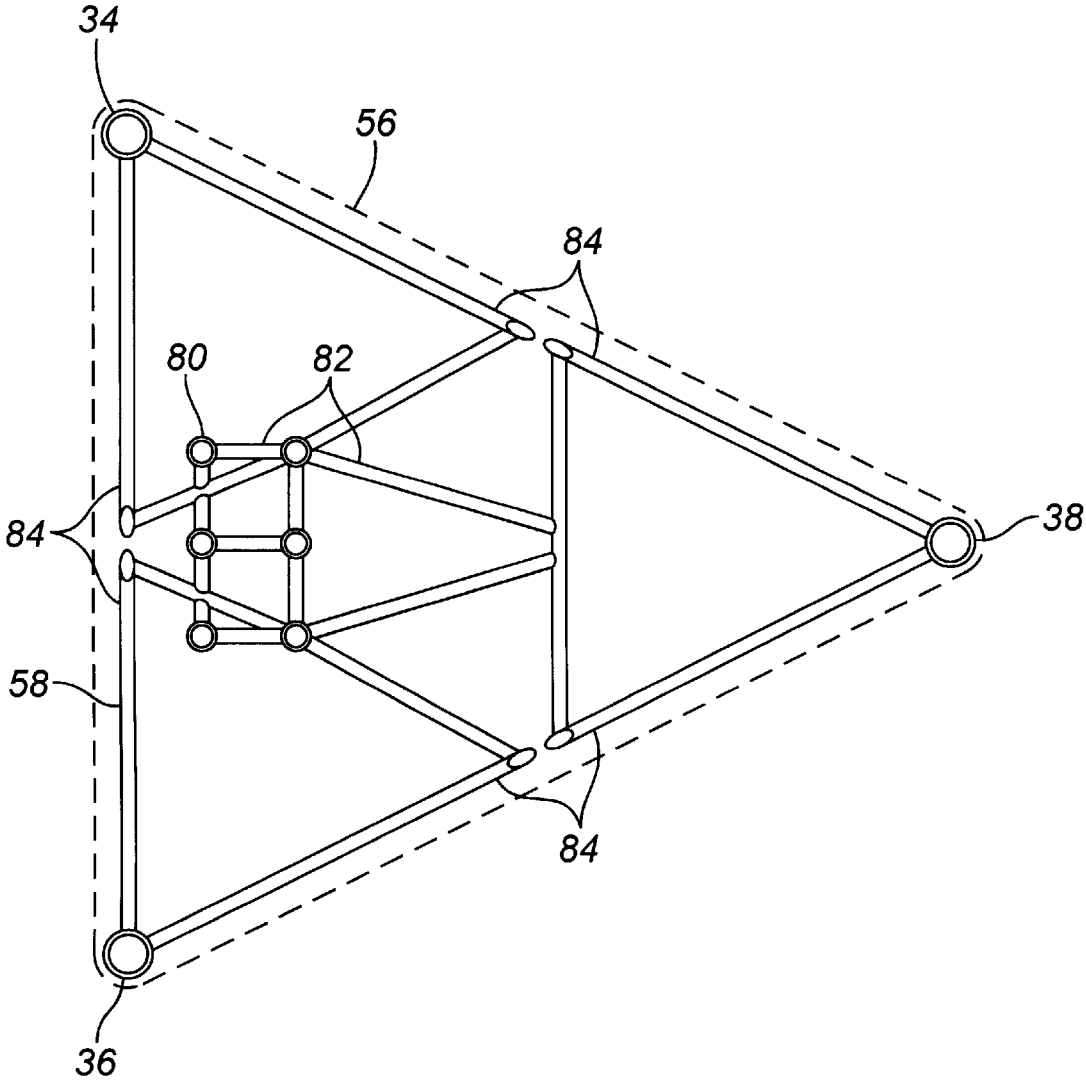
FIG. 7 is a plan view taken along the line 7—7 in FIG. 1.

FIG. 7 shows the third plurality of tubular guides 80 positioned inside the perimeter 56 of the jacket 22 and between the surface of the body of water 14 and the second plurality of tubular guides 72. The third plurality of tubular guides 80 are attache to the jacket 22 by a third plurality of cross brace members 82. This figure also illustrates a second plurality of cross structural brace members 84 which are arranged between and interconnect the first, second and third jacket legs 34, 36, 38.

Figure 6:
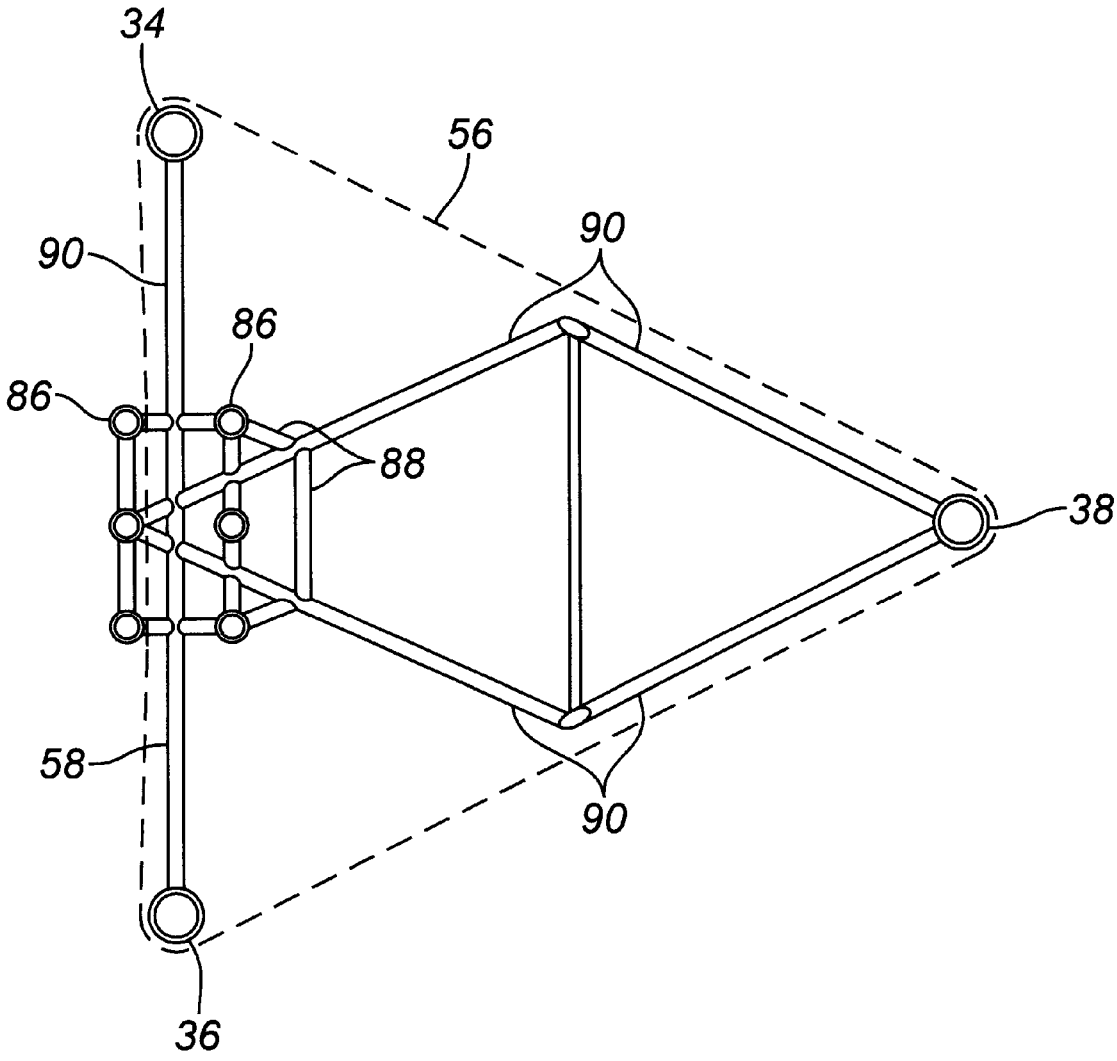
FIG. 6 is a plan view taken along the line 6—6 in FIG. 1.

FIG. 6 shows the fourth plurality of tubular guides 86 positioned partly outside the perimeter 56 of the jacket 22, outside the jacket face 58, and between the surface of the body of water 14 and the third plurality of tubular guides 80. The fourth plurality of tubular guides 86 are attached to the jacket 22 by a fourth plurality of cross brace members 88. This figure also illustrates a third plurality of cross structural brace members 90 which are arranged between and interconnect the first, second and third jacket legs 34, 36, 38. At this point on the jacket 22, there is one row of tubular guides outside the perimeter 56 of the jacket 22.

Figure 5:
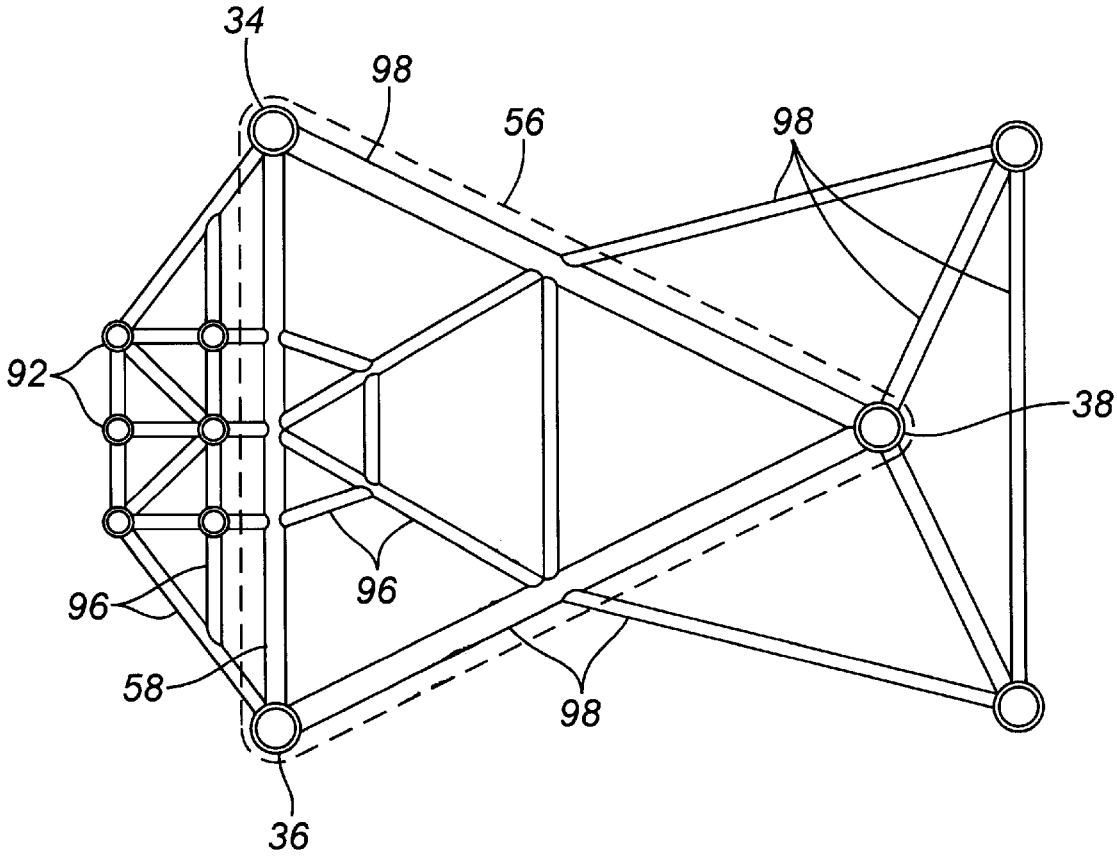
FIG. 5 is a plan view taken along the line 5—5 in FIG. 1.

FIG. 5 shows the fifth plurality of tubular guides 92 positioned outside the perimeter 56 of the jacket 22, outside the jacket face 58, and between the body of water 14 and the fourth plurality of tubular guides 86. The fifth plurality of tubular guides 92 being attached to the jacket 22 by a fifth plurality of cross brace members 96. This figure also illustrates a plurality of cross structural brace members 98 which are arranged between and interconnect the first, second and third jacket legs 34, 36, 38, and the support structure 24 for the deck or platform 26.

As shown in FIGS. 1 and 9, the base 20 can have a first base leg 100, a second base leg 102, a third base leg 104 and a fourth base leg 106 to comprise base legs 28, and the base frame 30 can have a first base frame member 108, a second base frame member 110, a third base frame member 112, a fourth base frame member 114, a fifth base frame member 116, and a sixth base frame member 118. In this embodiment, the first base leg 100 is connected to the third jacket leg 38 by the first base frame member 108; the first base leg 100 is connected to the second base leg 102 by the second base frame member 110; the second base leg 102 is connected to the third jacket leg 38 by the third base frame member 112; the fourth base leg 106 is connected to the third jacket leg 38 by the fourth base frame member 114; the third base leg 104 is connected to the first base frame member 108 by the fifth base frame member 116; and the fourth base leg 106 is connected to the third base frame member 112 by the sixth base frame member 118.

As set out above, preferably, the base 20 further comprises a first plate member 52 (FIG. 2) adapted to attach the first jacket leg 34 to the first base leg 100 and a second plate member 54 adapted to attach the second jacket leg 36 to the second base leg 102. The first and second plate members add additional strength and stability to the support structure 10.

Figure 11:
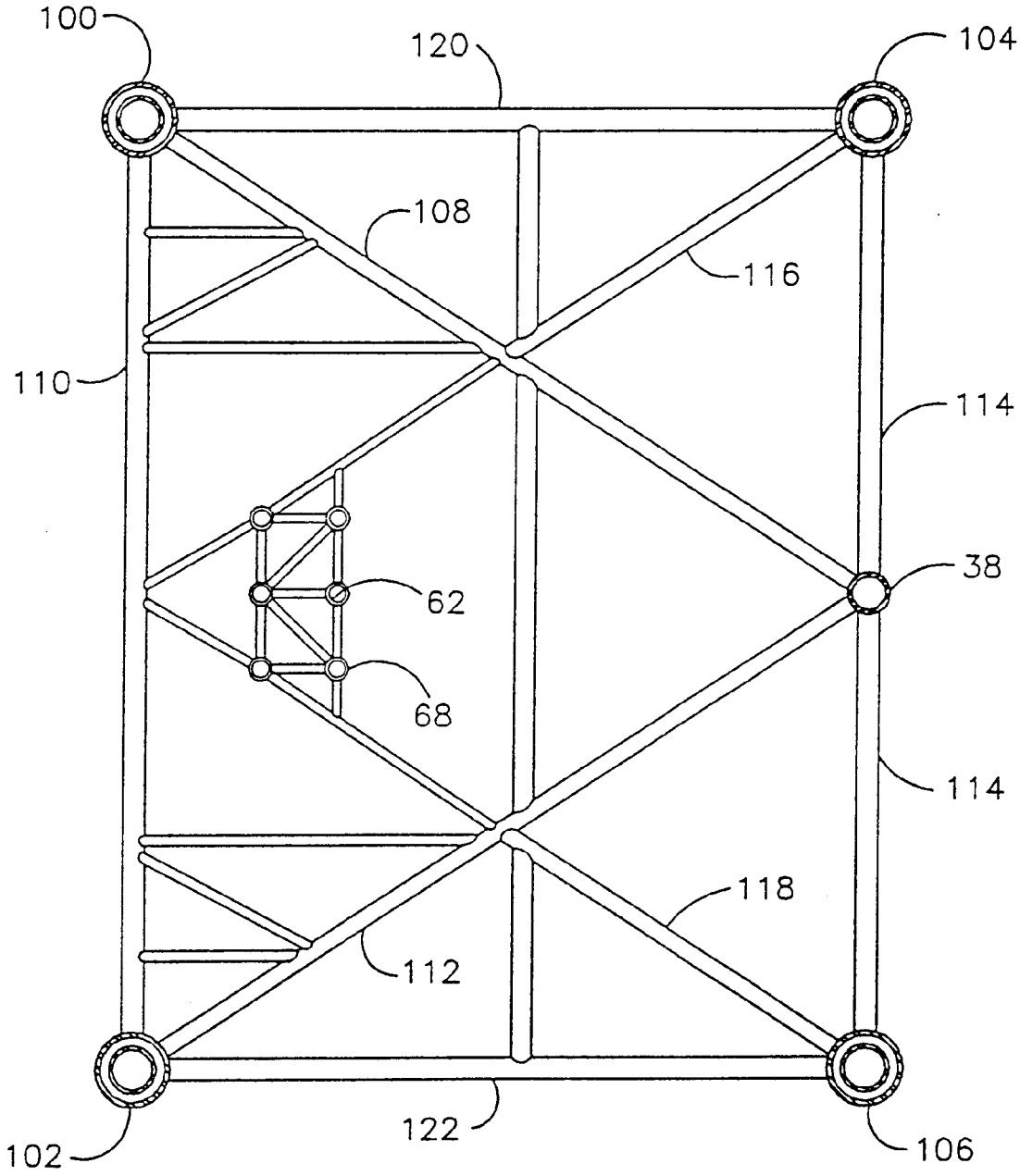
FIG. 11 is an alternate embodiment of the base of the support structure, the base being shown in a plan view.

There are several base configurations that will support the basic jacket structure outlined above and still maintain optimum efficiency and load bearing capabilities. In a second embodiment shown in FIG. 11, the base 20 comprises a first base leg 100, a second base leg 102, a third base leg 104 and a fourth base leg 106. The base also has a first base frame member 108, a second base frame member 110, a third base frame member 112, a fourth base frame member 114, a fifth base frame member 116, a sixth base frame member 118, a seventh base frame member 120, and an eighth base frame member 122. The first base leg 100 is connected to the third jacket leg 38 by the first base frame member 108; the first base leg 100 is connected to the second base leg 102 by the second base frame member 110; the second base leg 102 is connected to the third jacket leg 38 by the third base frame member 112; the fourth base leg 106 is connected to the third jacket leg 38 by the fourth base frame member 114; the third base leg 104 is connected to the first base frame member 108 by the fifth base frame member 116; the fourth base leg 106 is connected to the third base frame member 112 by the sixth base frame member 118; the first base leg 100 further is connected to the third base leg 104 by the seventh base frame member 120; and the second base leg 102 further is connected to the fourth base leg 106 by the eighth base frame member 122. Preferably, the third base leg 104, the third jacket leg 38, and the fourth base leg 106 are parallel to one another and are positioned in a common plane.

Figure 12:
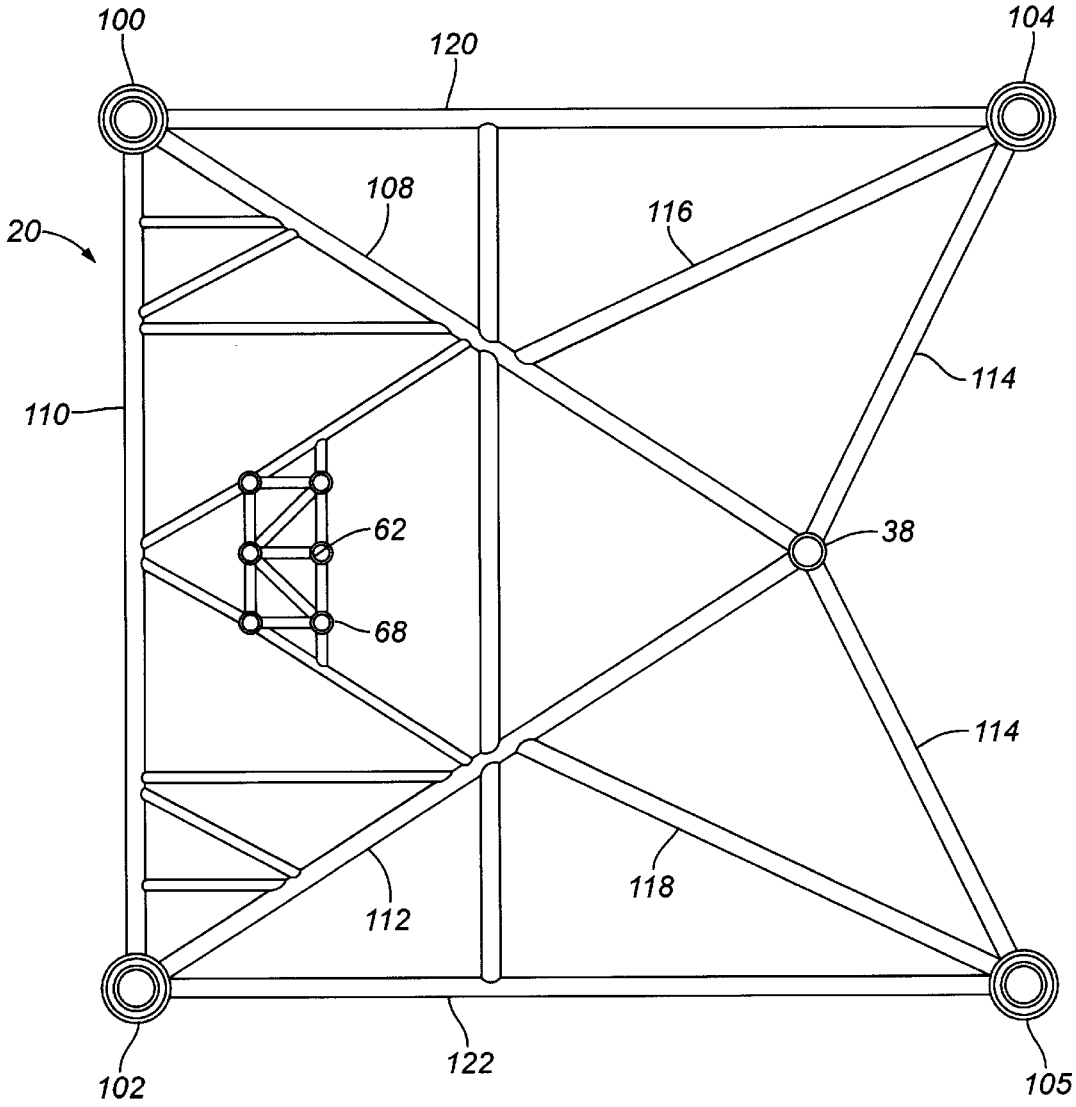
FIG. 12 is an alternate embodiment of the base of the support structure, the base being shown in a plan view.

In the alternative, the fourth base frame member 114 can have a first portion and a second portion, said first portion being connected between said third base leg 104 and said third jacket leg 38, and said second portion being connected between said third jacket leg 38 and said fourth base leg 106 to form a V-shape as shown in FIG. 12. The third jacket leg 38 is positioned between the first base leg 100 and the third base leg 104 so that the point of the V-shape is directed towards the second base frame member 110.

Figure 13:
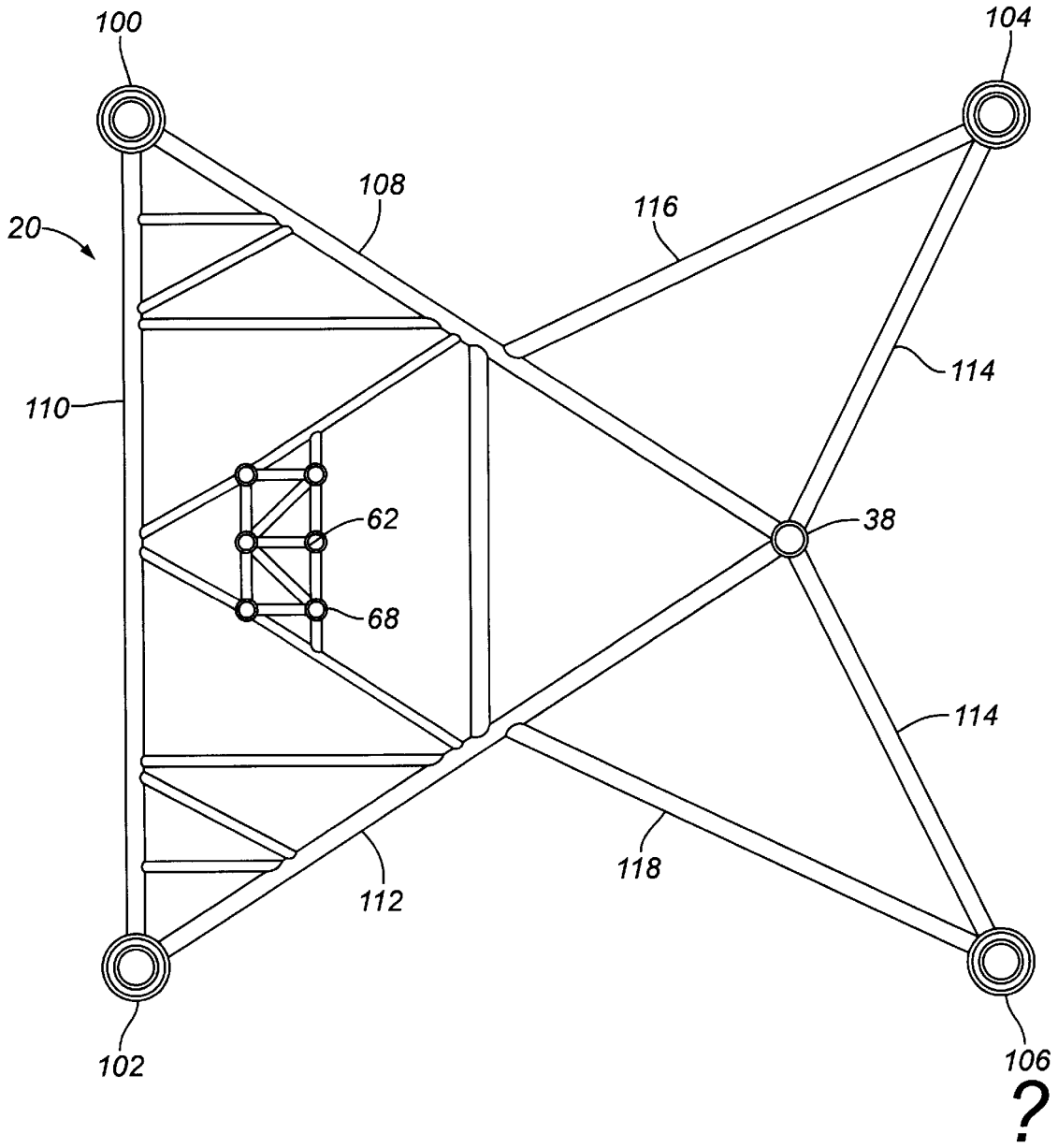
FIG. 13 is an alternate embodiment of the base of the support structure, the base being shown in a plan view.

In an alternate base structure shown in FIG. 13, the base 20 comprises a first base leg 100, a second base leg 102, a third base leg 104 and a fourth base leg 106. The base frame 30 comprises a first base frame member 108, a second base frame member 110, a third base frame member 112, a fourth base frame member 114, a fifth base frame member 116, and a sixth base frame member 118 as described above. The first base leg 100 is connected to the third jacket leg 38 by the first base frame member 108. The first base leg 100 is connected to the second base leg 102 by the second base frame member 110. The second base leg 102 is connected to the third jacket let 38 by the third base frame member 112. The fourth base leg 106 is connected to the third base leg 104 by the fourth base frame member 114. The third base leg 104 is connected to the first base frame member 108 by the fifth base frame member 116. The fourth base leg 106 is connected to the third base frame member 112 by the sixth base frame member 118.

Figure 14:
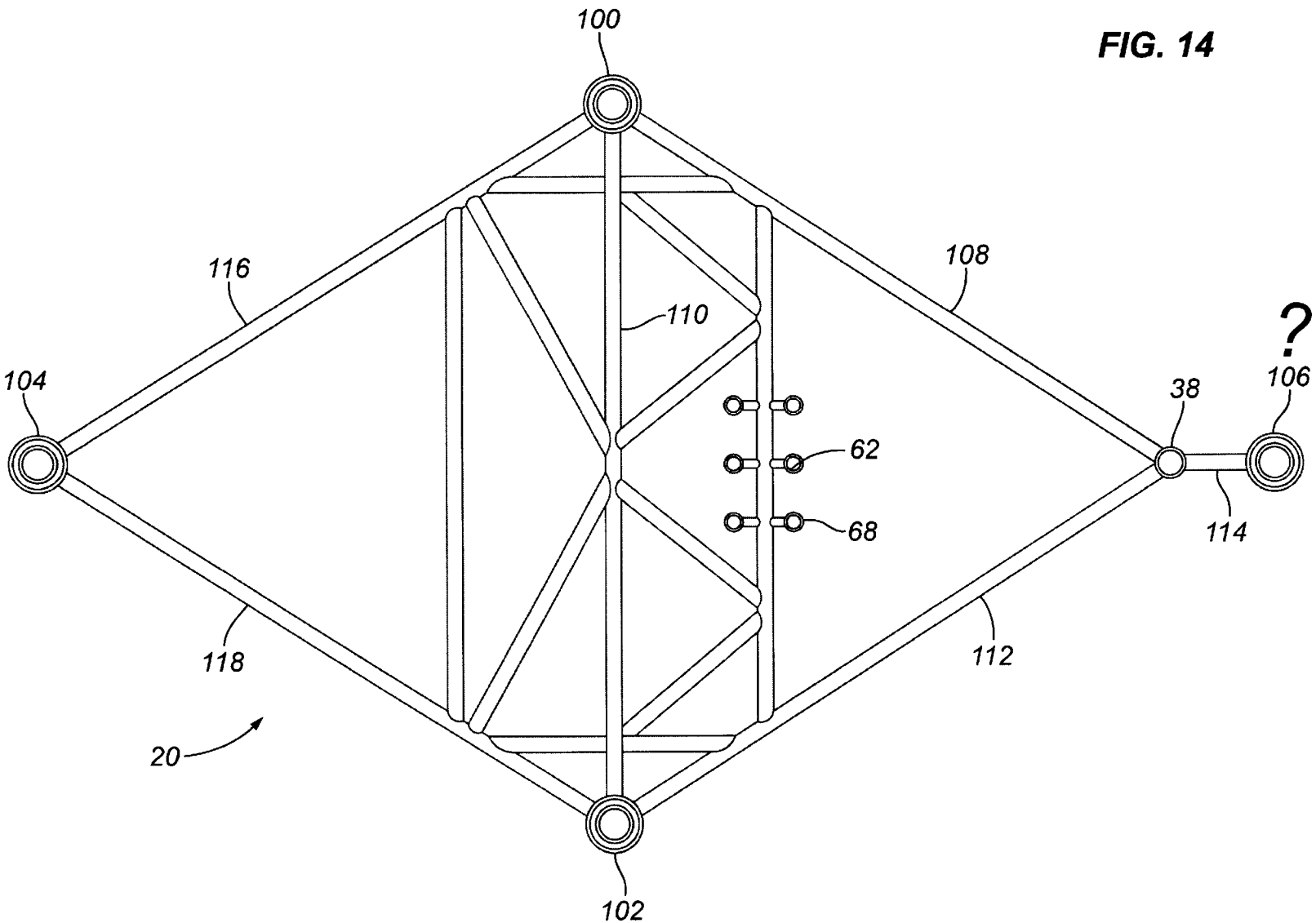
FIG. 14 is an alternate embodiment of the base of the support structure, the base being shown in a plan view.

In yet another embodiment shown in FIG. 14, the base 20 comprises a first base leg 100, a second base leg 102, a third base leg 104 and a fourth base leg 106. The base frame 30 comprises a first base frame member 108, a second base frame member 110, a third base frame member 112, a fourth base frame member 114, a fifth base frame member 116, and a sixth base frame member 118. The first base leg 100 is connected to the third jacket leg 38 by the first base frame member 108. The first base leg 100 is connected to the second base leg 102 by the second base frame member 110. The second base leg 102 is connected to the third jacket leg 38 by the third base frame member 112. The fourth base leg 106 is connected to the third jacket leg 38 by the fourth base frame member 114. The third base leg 104 is connected to the first base leg 100 by the fifth base frame member 116. The third base leg 104 is connected to the second base leg 102 by the sixth base frame member 118. Preferably, the first base leg 100, and the second base leg 102 are substantially vertical and are positioned in a common plane. Additionally, the first base leg 100, the second base leg 102 and the third jacket leg 38 form a generally triangular pattern.

While in accordance with the patent statutes, the best mode and preferred embodiments of the invention have been described, it is to be understood that the invention is not limited thereto, but rather is to be measured by the scope and spirit of the appended claims.

What is claimed is:

1. A support structure for use in supporting a structure for drilling and/or production operations, one end positioned above a body of water and another end below said body of water on a seabed, comprising:

a base having at least four cylindrical base legs engageably positioned in a polygonal pattern on a seabed and a base frame connected to said cylindrical base legs, wherein said cylindrical base legs are adapted to be subsurface;

a jacket having three jacket legs, wherein said jacket legs are interconnected to said base and said jacket legs are adapted to originate below the surface of the water and terminate above the surface of the water; and a support means for supporting the structure, said support means includes a portion of said first, second, and third jacket legs positioned above the surface of the water;

wherein there is a structure for drilling and/or production operations which has a plurality of well conductors and wherein:

said jacket has at least two of said jacket legs battered, with each of said legs being at an apex of a triangle when said jacket is viewed in plan.

2. The support structure of claim 1, wherein said polygonal pattern is rectangular.

3. The support structure of claim 1, wherein each of said cylindrical base legs is sized to engagably receive at least one pile, said pile being adapted to be driven into said seabed.

4. The support structure of claim 1, wherein said triangular shape is a substantially isosceles triangular shape.

5. The support structure of claim 1, wherein said jacket has a first jacket leg, a second jacket leg and a third jacket leg, said first jacket leg attached to one of said cylindrical base legs and said second jacket leg attached to another of said cylindrical base legs.

6. The apparatus of claim 5, wherein said first jacket leg, said second jacket leg and each of said cylindrical base legs to which they are attached are substantially vertically aligned.

7. The support structure of claim 5, wherein:

said first jacket leg, said second jacket leg, and said third jacket leg are attached to said base legs by a plurality of brace members.

8. The support structure of claim 7, wherein:

said base comprises a first base leg, a second base leg, a third base leg and a fourth base leg, and said base frame comprises a first base frame member, a second base frame member, a third base frame member, a fourth base frame member, a fifth base frame member, a sixth base frame member and a seventh base frame member;

said first base leg being connected to said third jacket leg by said first base frame member;

said first base leg being connected to said second base leg by said second base frame member;

said second base leg being connected to said third jacket leg by said third base frame member;

said fourth base leg being connected to said third jacket leg by said fourth base frame member;

said third base leg being connected to said third jacket leg by said seventh frame member and being connected to said first base frame member by said fifth base frame member; and said fourth base leg being connected to said third base frame member by said sixth base frame member.

9. The support structure of claim 7, wherein said base further comprises a first plate member and a second plate member, said first plate member being adapted to attach said first jacket leg to said first base leg, and said second plate member being adapted to attach said second jacket leg to said second base leg.

10. The support structure of claim 1, wherein said base further comprises a first plurality of tubular guides for receiving and supporting the plurality of the well conductors and a first plurality of cross brace members, wherein said first plurality of tubular guides are attached to said base frame by said first plurality of cross brace members.

11. The support structure of claim 10, wherein said first plurality of cross brace members are connected at one end to said tubular guides and at the other end to said base frame.

12. The support structure of claim 10, wherein said jacket includes a first jacket leg, a second jacket leg, a third jacket leg and a plurality of angularly extending brace members connected between said first jacket leg, said second jacket leg and said third jacket leg to form a multi-sided structure defining a perimeter, said jacket further defining at least one jacket face between said adjacent jacket legs.

13. The support structure of claim 1, wherein there is further included a set of brace members and wherein:

said base comprises a first base leg, a second base leg, a third base leg and a fourth base leg, and a first base frame member, a second base frame member, a third base frame member, a fourth base frame member, a fifth base frame member, a sixth base frame member, a seventh base frame member, and an eighth base frame member;

said base legs and base frame members being connected to said jacket legs by said brace members;

14. The support structure of claim 1, wherein said base frame extends between said cylindrical base legs to which first and second jacket legs are attached and to said third jacket leg to form a substantially triangular shape.

15. A support structure for use in supporting a structure for drilling and/or production operations having a plurality of well conductors, one end positioned above a body of water and another end below said body of water on a seabed, comprising:

a base having at least four cylindrical base legs engageably positioned in a polygonal pattern on a seabed and a base frame connected to said cylindrical base legs, wherein said cylindrical base legs are adapted to be subsurface;

a jacket having three jacket legs, wherein said jacket legs are interconnected to said base and said jacket legs are adapted to originate below the surface of the water and terminate above the surface of the water; and a support means for supporting the structure, said support means includes a portion of said first, second, and third jacket legs positioned above the surface of the water;

wherein said base further comprises a first plurality of tubular guides for receiving and supporting the plurality of the well conductors and a first plurality of cross brace members, wherein said first plurality of tubular guides are attached to said base frame by said first plurality of cross brace members;

wherein said jacket includes a first jacket leg, a second jacket leg, a third jacket leg and a plurality of angularly extending brace members connected between said first jacket leg, said second jacket leg and said third jacket leg to form a multi-sided structure defining a perimeter, said jacket further defining at least one jacket face between said adjacent jacket legs; and wherein the well conductors intersect said jacket face formed between the first jacket leg and the second jacket leg at an intersection position, said intersection position being between said base and the surface of the water.

16. The support structure of claim 15, wherein the well conductors have a first end above the surface of the water and a second end extending upward from the bed below the water, the second end being received by said first plurality of tubular guides and being positioned inside said perimeter of said jacket near said base.

17. The support structure of claim 15, wherein the well conductors intersect said jacket face at said intersection position so that the first end of the well conductors is outside said perimeter of said jacket and the second end of the well conductors is inside said perimeter of said jacket.

18. The support structure of claim 15, further including:

a second plurality of tubular guides attached to said jacket, said second plurality of tubular guides being positioned inside said perimeter of said jacket between the surface of the body of water and said first plurality of tubular guides, and a second plurality of cross brace members, said second plurality of tubular guides being attached to said jacket by said second plurality of cross brace members.

19. The support structure of claim 18, further including:

a third plurality of tubular guides attached to said jacket, inside said perimeter of said jacket and between the surface of the body of water and said second plurality of tubular guides, and a third plurality of cross brace members said third plurality of tubular guides being attached to said jacket by said third plurality of cross brace members.

20. The support structure of claim 19, further including:

a fourth plurality of tubular guides attached to said jacket, outside said perimeter of said jacket and between the surface of the body of water and said third plurality of tubular guides, and a fourth plurality of cross brace members, said fourth plurality of tubular guides being attached to said jacket by said fourth plurality of cross brace members.

21. The support structure of claim 20, further including:

a fifth plurality of tubular guides attached to said jacket, outside said perimeter of said jacket and between the surface of the body of water and said fourth plurality of tubular guides, and a fifth plurality of cross brace members, said fifth plurality of tubular guides being attached to said jacket by a fifth plurality of cross brace members.

22. The support structure of claim 15, further including an additional plurality of tubular guides and an additional plurality of cross brace members.

23. A support structure for use in supporting a structure for drilling and production operations having a plurality of well conductors, one end positioned above a body of water at the structure and another end below the body of water on a bed, comprising:

a base having cylindrical base legs engageably positioned on the bed and a base frame connected to said cylindrical base legs, wherein said cylindrical base legs are adapted to be subsurface;

a jacket having a first jacket leg and a second jacket leg, wherein said first jacket leg and said second jacket leg are attached to said cylindrical base legs, wherein said first jacket leg and said second jacket leg form a jacket face therebetween and said jacket having a support means for supporting the structure; and a plurality of tubular guides for receiving and supporting the plurality of well conductors, wherein said plurality of tubular guides are positioned on the support structure so that the first end of the well conductors is outside said face of said jacket and the second end of the well conductors is inside said face of said jacket.

24. The support structure of claim 23, wherein said base has at least four cylindrical base legs positioned in a generally rectangular pattern on the seabed.

25. The support structure of claim 23, wherein said jacket further comprises a third jacket leg attached to said base frame, and said first, second, and third jacket legs are adapted to originate below the surface of the water and terminate above the surface of the water.

26. The support structure of claim 25, wherein said base frame extends between said cylindrical base legs to which said first jacket leg and said second jacket leg are attached and said third jacket leg to form a substantially triangular shape.

27. The support structure of claim 26, wherein said support means includes a portion of said first, second, and third jacket legs positioned above the surface.

28. An offshore platform for use with pile foundations and pile receptacles connected to a seabed extending from a seabed to an active wave zone, comprising:

a base having two sides, one top side and one bottom side, and located above the seabed and below the active wave zone;

three substantially vertical and substantially equidistant main jacket members extending through the active wave zone, said base being connected to said three main jacket members on the top of said base facing the active wave zone, at least one of said main jacket members being inclined from the vertical;

said base including a foundation system which encompasses the vertical projection of any of said three main jacket members that are inclined from the vertical;

four main substantially vertical and substantially equidistant legs positioned in a rectangular pattern on the seabed, said base being connected to said four main legs on the bottom of said base facing the seabed;

said four main legs adapted to being connected to the pile foundations by the pile receptacles;

four substantially vertical tubular members comprising deck support, said three main jacket members connected to said four vertical tubular members;

whereby, said deck support provides space and structural support for production facilities and drilling equipment.

29. An offshore platform for use with pile foundations and pile receptacles connected to a seabed and extending from a seabed to an active wave zone, comprising:

a base having a top facing the active wave zone and a bottom facing the seabed and being located above the seabed and below the active wave zone;

four substantially vertical and substantially equidistant main jacket members extending through the active wave zone, said base being connected to said four main jacket members on the side of said top, at least two of said main jacket members being inclined from the vertical;

said base including a foundation system which encompasses the vertical projection of any of said four main jacket members that are inclined from the vertical;

five main substantially vertical and substantially equidistant legs positioned in a pentagonal pattern on the seabed, said base being connected to said five main legs on said bottom;

said five main legs adapted to being connected to the pile foundations by the pile receptacles;

four substantially vertical tubular members comprising deck support, said four main jacket members connected to said four vertical tubular members;

whereby, said deck support provides space and structural support for production facilities and drilling equipment.

* * * * *